United States Patent [19]

Sharples

[11] Patent Number: 4,759,461

[45] Date of Patent: Jul. 26, 1988

[54] CONTAINER CLOSURE MEANS

[75] Inventor: Leonard Sharples, Scarborough, England

[73] Assignee: Splicerite Limited, West Yorkshire, England

[21] Appl. No.: 828,022

[22] Filed: Feb. 10, 1986

[30] Foreign Application Priority Data

| | | | |
|---|---|---|---|
| Feb. 14, 1985 | [GB] | United Kingdom | 8503814 |
| May 10, 1985 | [GB] | United Kingdom | 8511926 |
| May 28, 1985 | [GB] | United Kingdom | 8513382 |
| Jul. 31, 1985 | [GB] | United Kingdom | 8519225 |

[51] Int. Cl.[4] ..... B65D 53/02

[52] U.S. Cl. ..... 220/93; 222/209; 222/213; 222/386.5

[58] Field of Search ..... 220/93, 307; 222/209, 222/213, 386.5, 212, 213, 327, 386

[56] References Cited

U.S. PATENT DOCUMENTS

| | | | |
|---|---|---|---|
| 2,096,358 | 10/1937 | Gautier | 220/93 |
| 4,209,105 | 6/1980 | Dominique | 220/93 |
| 4,640,442 | 2/1987 | Drobish | 222/209 |

*Primary Examiner*—George T. Hall

*Attorney, Agent, or Firm*—Anthony Lagani, Jr.

[57] ABSTRACT

An end cap for a container is generally dish shaped and is for fitting within a tubular container to be fixed in position at one end thereof or for sliding movement within the container as the container is emptied. The end cap includes a peripheral portion 129 which is capable of limited movement relative to the main portion of the end cap so as to allow movement of the end cap in one direction within the container but to cause locking of the end cap against the wall of the container when the end cap is caused to move in the opposite direction.

5 Claims, 5 Drawing Sheets

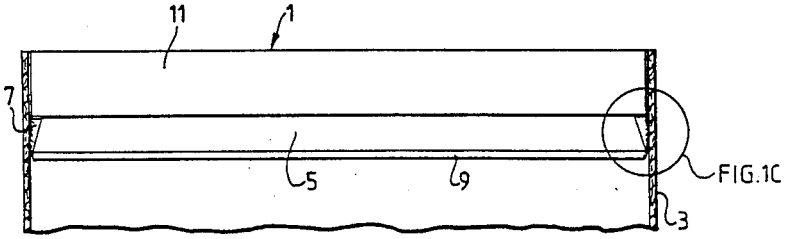
FIG.1A.
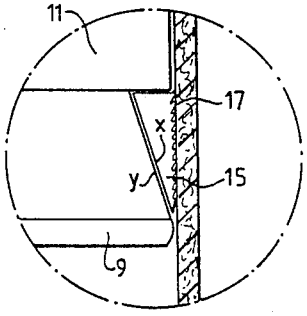
FIG.1C.
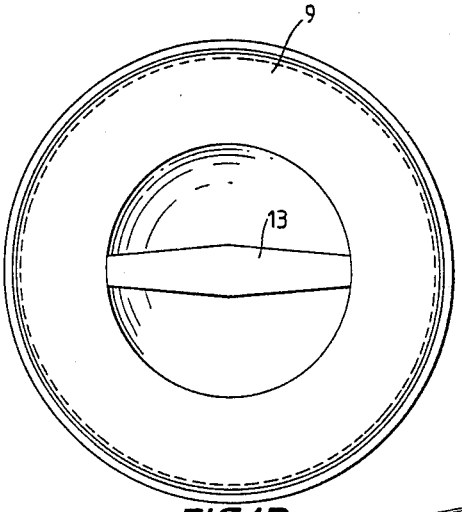
FIG.1B.
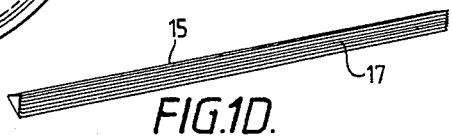
FIG.1D.
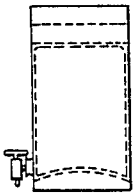
FIG.1F.
FIG.1E
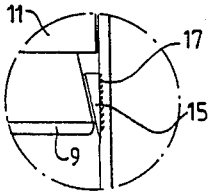

CONTAINER CLOSURE MEANS

This invention relates to containers for liquids, gases or solids.

One type of container with which the present invention is concerned is a container having a top which may be moved, typically downwardly, to take up space otherwise left as a result of the partial emptying of the contents of the container. For instance, the container may be for holding a powdered or granular solid such as a washing powder. Another example of a container of this type is a container which will be referred to hereinafter as a "bag in a tube" liquid container.

As used herein, the term "bag in a tube" liquid container refers to a liquid container in the form of a flexible plastics bag located within a rigid tube, the bag having associated with it an outlet valve or tap which projects through the wall of the tube near the base thereof. The tube may be made of cardboard and the base of a plastics material. Such a device is known for containing an amount of beer, typically of the order of 5 liters. Above the bag the container is fitted with a slider or end cap which initially forms a top for the container but is fitted within the tube. This end cap is capable of sliding movement along the longitudinal axis of the tube and in particular may be pressed in a direction towards the base of the bag so as to cause it to slide theretoward. The end cap is provided with means whereby it may be "locked" or fixed at a particular longitudinal position with respect to the tube. In this way the end cap may be pushed down to compress the bag to take up any space resulting from the draining off of liquid via the tap. Unless this is done the beer or other liquid in the bag will go flat due to the escape of gas (normally carbon dioxide) into the aforementioned space. Accordingly as the liquid is drained off for consumption, the end cap is moved down so that, as far as possible, the liquid in the bag is maintained with no space within the bag and above the liquid into which the gas may escape.

In the known bag in a tube construction the end cap is essentially a three part arrangement comprising a first part in the form of a disk having a relatively deep circumferential flange extending from one side thereof and having an integral hub. This first part is an easy fit within the tube for sliding movement longitudinally with respect thereto. The second part of the end cap is a disc shaped member provided with a central boss for location within the hub of the first part and also provided with circumferentially spaced apart slits extending from the outer edge of the dish a substantial distance inwardly to the centre of the dish. The radius of this second part is slightly greater than that of the first part so that the second part is a relatively tight fit within the tube. The third part of the end cap is a handle provided with a screw threaded portion for engagement with an internal screw thread provided in the boss of the second part. When assembled the handle and the dish-shaped second part are arranged on opposite sides of the first part of the construction. With the end cap in place within the tube, the handle may be turned in one direction to draw the dish-shaped second part towards the first part thereby flattening the dish to cause it to engage more firmly against the wall of the tube. This results in the end cap as a whole being "locked" against the wall of the tube. Rotating the handle in the opposite direction relieves the pressure on the dish member so that it returns to its more dish-shaped initial position thereby gripping the wall of the tube less firmly. The end cap can then be moved relative to the tube towards the base thereof to take up any space resulting from draining of liquid from the bag. After this downward movement of the end cap the handle may be turned again to "lock" the end cap against the wall of the tube. As mentioned above the end cap is essentially a three part construction and, as such, is a relatively expensive item to produce involving as it does separate moulding operations for the three parts. It would be advantageous to produce a end cap having fewer parts.

According to the present invention there is provided a container having a side wall or walls and end walls, at least one end wall being in the form of a cap comprising a first portion which, in use, extends substantially across the whole of one end of the container within said side wall or walls, and a second portion disposed about the periphery of said first portion and co-operative with said first portion to allow movement of the end cap towards the opposite end of the container but to prevent movement of the end cap away from the opposite end wall of the container.

In the case where the container is a "bag in a tube" liquid container, the end cap is in the form of a "slider". The arrangement is such that, in use, a downward force applied to the end cap effects substantially simultaneous downward movement of the first and second portions of the end cap to compress the bag about the liquid container therein, and upward movement of the end cap, due to pressure exerted within the bag, causes substantially immediate locking engagement of the first and second portions of the end cap and the wall of the tube to prevent any further upward movement.

The second portion may be an annular or part-annular member trapped within a space defined by said first portion and said wall of the tube, said space being sufficient to accommodate said second portion but not to permit any significant movement of the second portion relative to the first portion.

Preferably, the second portion and space are shaped so that any initial upward movement of the end cap causes a rotational movement of the second portion which in turn results in said substantially immediate locking engagement.

Alternatively the second member could be in the form of a collar lying between the first portion and the wall of the tube, the collar and the first portion having mating surfaces which have inclination relative to the longitudinal axis of the tube such that upward pressure applied to the end cap from within the bag will cause locking engagement between the first and second portions of the end cap and the wall of the tube, whereas downward pressure applied to the end cap will release said locking engagement and permit downward movement of the end cap as a whole.

An end cap in accordance with the present invention may be a two part construction involving two separate plastics mouldings. Alternatively it may be a single plastics moulding in which the first and second parts of the end cap are, at least when produced in a moulding process, a single integral arrangement.

The present invention further provides an end cap for a container of the invention, the end cap being as defined above.

The present invention may also be applied to containers where the or each end wall is not intended to move to take up space vacated during the evacuation of the contents of the container. For instance, such a container may be in the form of a "keg" for storing, for instance, liquid beer or lager under pressure, the keg having one or both opposed end walls constructed similarly to the above-described end cap for a "bag in a tube" liquid container. However, in this case once the end wall is mounted in position it remains permanently in this position In another embodiment the container is for storing solids such as a washing powder. In this case an end cap in accordance with the invention may be introduced at one end of a rigid tube, caused to "lock" and then permanently secured in position to form, for instance, a secure base or top for the container.

Embodiments of the present invention will now be described, by way of examples only, and with reference to the accompanying drawings, in which:

FIGS. 1A to 1F are views of a container incorporating a first embodiment of an end cap in accordance with the present invention;

Figure 2A:
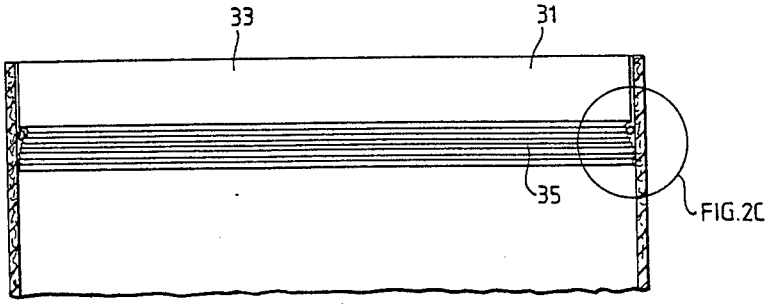
FIGS. 2A to 2D are views of a second embodiment of an end cap in accordance with the present invention.
Figure 2C:
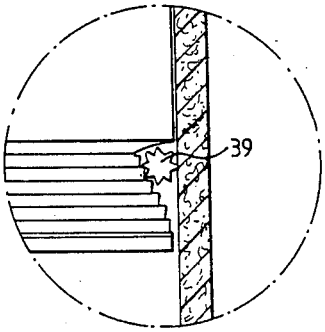
Figure 2B:
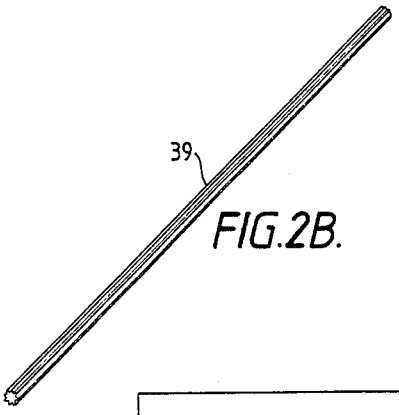

Referring to FIGS. 1A to 1F of the accompanying drawings a bag in the tube container is of known design (see FIG. 1E) as described above, apart from the end cap 1 located within the circular cylindrical wall 3 of the tube. The end cap 1 is a two part plastics construction which includes a main part 5 and a minor part 7. Main part 5 is formed of hard plastics material such as polypropylene, polyethylene or a styrene based plastics material. It is of a generally flat dished shape having a substantially circular base 9 and a peripheral flange or side wall 11 extending close to the side wall 3 of the tube in a direction away from the base (not shown) of the blocks.

As best seen in FIGS. 1A and 1C, flange 11 extends from base 9 of the end cap initially upwardly and inwardly and then radially outwardly to define a wedge shaped space between the outer surface of flange 11 and the side wall 3 of the box. The flange then extends upwardly close to the side wall of the tube.

Referring to FIG. 1B, showing the top plan view of the end cap within the box, the main part 5 of the end cap includes a central integral section having a handle portion 13 enabling the end cap to be gripped for longitudinal movement relative to the tube as will be described below.

Located within the above-mentioned wedge shaped space is a ring 15 of plastics material which is illustrated in FIG. 1D as a straight length of material. In section the material is wedge shaped for a snug fit within the wedge shaped space described above. As best seen in FIG. 1C, the ring 15 has a section in the form of a right-angled triangle with one relatively short side so the wedge is highly elongate. The edge of ring 15 forming the hypotenuse of the triangle contacts the inclined surface of the flange 11 of the main part 5 of the end cap and the other relatively long edge is provided with integral longitudinal ribbing 17, each rib having upwardly directed points as shown in FIG. 1C.

The material of ring 15 is a relatively flexible plastics material so that, although the ring is produced in straight form as shown in FIG. 1D, it may be easily bent to a split ring configuration for mounting between the main part 5 of the end cap and the wall 3 of the tube.

It can be seen in FIG. 1C that the split ring 15 is held captive within a space which corresponds to the ring 15 so that the latter is a snug fit within this space, and any relative movement of the end cap and the tube is only possible if the ring 15 also moves. Such relative movement is possible if a downward force is applied to the end cap via the handle 13. Assuming that there is space to be taken up as a result of partial emptying of liquid from the bag via the tap, then the end cap 1 can move downwards relatively easily taking with it the split ring 15, there being relatively little resistance to movement between the two parts of the end cap 1 and the wall 3 of the tube. Normally the end cap will be pressed down until it takes up any space resulting from partial emptying of liquid from the bag. On releasing the pressure applied to the end cap via the handle, there will be a net upward pressure on the end cap from the contents of the bag. However, this pressure will be insufficient to overcome the relatively greater friction between the end cap and the wall 3 of the tube. Any tendency to upward movement by split ring 15 is strongly resisted by the engagement of the pointed ribs 17 with the tube wall. The main part 5 of the end cap will move upwards slightly relative to split ring 15, as shown in exaggerated detail in FIG. 1F, but the extent of such upward movement is very much restricted by the inclined nature of the contacting surfaces (shown as X and Y in FIG. 1C) of the two parts of the end cap and, as will be appreciated, any slight upward movement only tends to press the points of rib 17 more firmly into engagement with the wall 3 of the tube. In practice, there is a minimal or negligible upward movement before the end cap is firmly "locked" in position with respect to the wall 3 of the tube.

Although not shown in FIG. 1, the end cap may be provided with strengthening ribs, for instance, extending radially from the centre of main part 5 to the peripheral wall 11 thereof.

Referring to FIGS. 2A to 2D, a second embodiment in accordance with the present invention is generally similar to the first above-described embodiment. However, in this case the end cap 31 has a main part 33 provided with a lower section which is itself serrated on its outer surface as indicated at 35 in FIGS. 2A and 2D. As can be best seen in FIG. 2D, the wedge shaped space between the main part 33 of end cap 31 and the wall 37 of the tube is still present but, lodged within this space is a split ring having a star shaped section with a star having perhaps four to eight points. As a result the section of the ring is serrated in a manner roughly complementary to the serrated edge 35 of the lower part of the end cap 33. Above the split ring 39 the end cap is gently curved (concavely with respect to ring 35) so as to form the short edge of the generally right angled triangle wedge-shaped space.

Figure 2D:
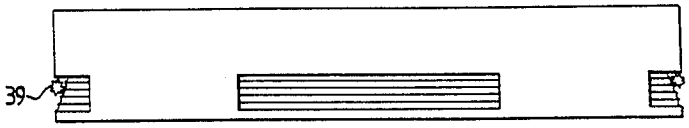

Downward pressure on the end cap 33 results in relatively little friction between the end cap and the wall of the tube with the ring 39 being in the position shown in FIG. 2D. However, upward pressure on the end cap tends to cause ring 39 to rotate so as to tend to run downwardly along serrated edge 35 and thereby into engagement with wall 37 of the tube. As a result there is strong resistance to upward movement of the end cap relative to the tube with the "teeth" of the ring 35 biting into the wall 37 of the tube and the ring itself being squeezed between the inclined serrated edge 35 and the wall of the tube.

In a modification of this embodiment of the invention, the tooth surface 35 may itself be segmented as shown in FIG. 2A. In a further development, the ring 39 may be of generally smooth section and moulded integrally with the main body of end cap 33 in a manner analagous to that described above with reference to the second embodiment of the invention.

Referring to FIGS. 3A to 3D of the accompanying drawings, a bag in a tube container is generally described above with reference to the first embodiment of the present invention. The container includes an end cap 121 provided with reinforcing ribs 123. A handle (not shown) may also be provided. The end cap is generally dish shaped having an integral circular peripheral wall 125 which, when the end cap is fitted within the container, one end thereof extends downwardly towards the ther end of the container. The outer diameter of the end cap as a whole is such that it is a snug fit within the wall of the tube of the container.

Extending upwardly from the opposite side of the central dish of the end cap 121 to that of peripheral wall 125 is a circular flange 127. This flange is positioned somewhat inwardly from the outer edge of the end cap so that, when the end cap is fitted within the container, there is an annular space between the flange and the wall of the container. Integral with the end cap and extending into this annular space are sections or segments 129, each of which extends about a portion of the circumference of the end cap. There are four such sections 129 which together cover the entire circumference, typically having gaps between adjacent sections of the order of ½mm or so.

Figure 3A:
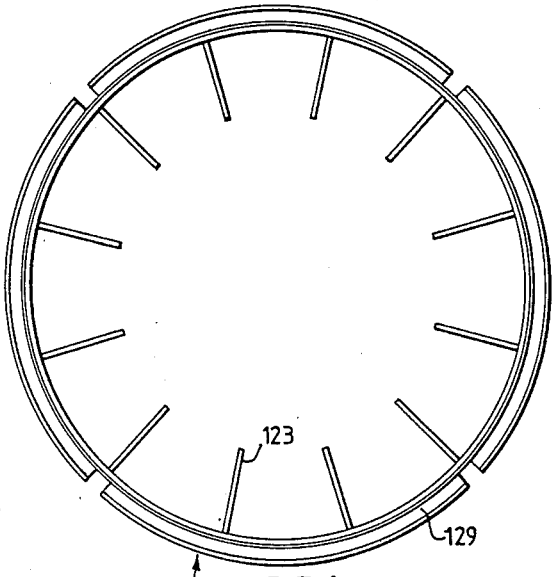
FIGS. 3A to 3D are views of a third embodiment of an end cap in accordance with the present invention.
Figure 3B:
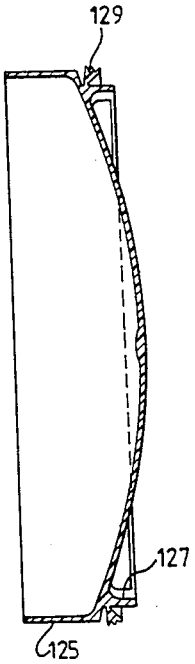
Figure 3C:
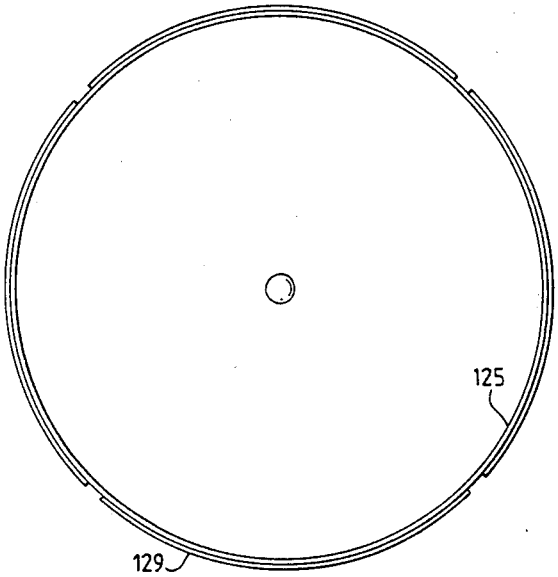
Figure 3D:
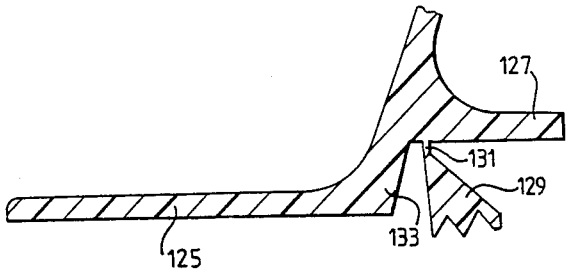

Referring particularly to FIG. 3D, it will be seen that section 129 is of generally triangular shape and is connected to the main body of the end cap by a thin section of material 131. The material of the end cap is such that at this point the section 129 is able to rotate readily about section 131. However, the extent of rotation is limited, particularly in a clockwise direction as viewed in FIG. 3D, due to engagement of section 129 with the shoulder 133 formed between the central dish of the end cap and the wall 125. The distance between this shoulder and section 129 in its rest position increases from a minimum of about 1 mm close to the joint portion 131 to a maximum of about 2.5 mm at the peripheral edge of the shoulder 133.

The joint portion 131 forms an apex to the triangular section of section 129. Opposite the apex the side of section 129 is serrated. Typical dimensions of section 129 are a serrated edge of about 5 mm (measured along its outer extremity), a longest side of about 6 mm and the opposite side at about 5 mm. The end cap as a whole has an outside diameter of 180.5 mm and the above-mentioned annular space has a radial width of about 4.7 mm.

In use the end cap 121 may be pushed down against the bag located in the tube. During such movement section or segment 129 is forced into that part of the annular base lying above the point of attachment 131. However, if the lid is pushed up by the bag then section 129 will rotate in a clockwise direction, as viewed in FIG. 3D, and hence into firm contact with the tube wall, thereby hindering any further upward movement of the end cap as a whole.

In the above-described embodiments the tube itself may typically be made of cardboard material and the end cap of plastics. However, other materials may be used. For instance, the tube may be made of metal or plastics. Furthermore, the tube may be of any suitable shape, for instance, circular, square, rectangular or hexagonal.

It should be appreciated that in all the above-described embodiments, an upward pressure on the end cap will cause an instantaneous, or almost instantaneous and greatly increased resistance to movement. There is no "slack" to be taken up before such resistance to movement becomes substantial and hence the creation of a gaseous space above the liquid in the bag is avoided.

Figure 4A:
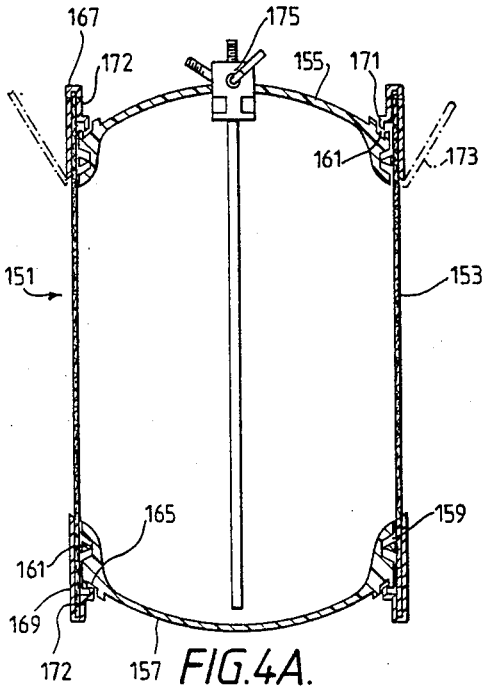
FIGS. 4A and 4B are views of a beer or lager keg in accordance with the present invention.
Figure 4B:
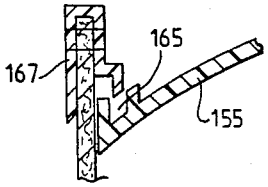

Referring to FIGS. 4A and 4B, a further container in accordance with the present invention is in the form of a beer or lager "keg" 151 which may be of, for instance, 20, 30 or 50 liter capacity. The keg 151 is of generally circular cylindrical shape, having a side wall 153 made of, for instance, cardboard which may be lined interiorly with appropriate liquid impermeable and resistant mediums such as a plastics material. At its top and bottom, the tube formed by side wall 153 is closed by top member 155 and base member 157 respectively. Each comprises a dish-shaped plastics member having a thickened circumferential edge portion formed with an annular outwardly facing recess 159. Mounted within recess 159 is a complete or segmented locking member 161 which may be similar in form to the corresponding members of the end caps of any of the above-described embodiments of the present invention.

The above-mentioned thickened peripheral portions of top and base members 155 and 157 are each provided with a pair of annular flanges extending from the concave surface of the member and so as to define a recess 165.

The keg 153 is provided with end securing devices or chimbs 167 and 169 which are plastics rings shaped as shown in the accompanying drawings and for fitting over the ends of tubes 153 in order more securely to fix closure members 155 and 157 in position and to protect the ends of the tube. These chimbs 167 and 169 are made of plastics material and include a channel section for fitting over the end of tube 153, the inner arm of the channel being provided with an inwardly stepped end portion 171 for engagement within recess 165 of the corresponding end closure member 155 or 157. Chimbs 167 and 169 are stitched in position by means of a line of stitching 172 extending circumferentially about at least a part of the chimb and through both arms of the chimb and the tube 153. The chimb 167 is associated with the top closure member 155 and is provided with carrying handles 173.

The top closure member 155 has fitted therein spear 175. This item is a standard feature of known kegs and enables the filling and emptying of the keg as well as the application of gas pressure. In order to assemble keg 151 end closure members 155 and 157 are pushed appropriate distances into the respective ends of tube 153, and then parallel in order to cause "locking" of these members against the wall of the tube 153. Chimbs 167 and 169 are then located over the ends of the tube 153 so that the inwardly stepped portions 171 engage in the corresponding recesses 165 of the closure members. The chimbs are then stitched in position and the keg filled with, for instance, beer or lager by means of spear 175. The pressure within the keg tends to force the closure members 155 and 157 out of the keg but this is prevented by the "locking" action of members 161 as well as the engagement of the closure members with the chimbs.

The above-described keg is a relatively cheap item to manufacture and is at least as easy to use and handle as known beer or lager kegs. It may be manufactured in a form which is reusable or possibly for a single use only.

Figure 5:
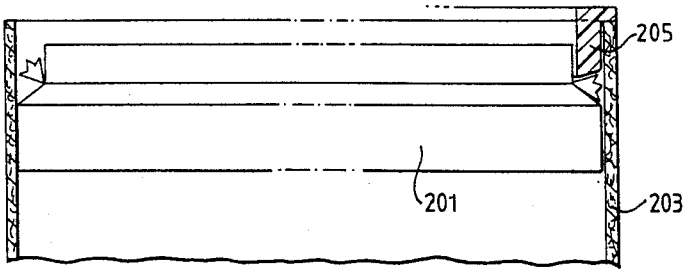
FIG. 5 is a view of part of an end cap of the invention for use with a container for solids.

Referring to FIG. 5 of the accompanying drawings, an end cap 201 may be used in a circular cylindrical tube 203 to form a container for holding solids such as powdered or granular solids, for instance, a washing powder. In this case the end cap 201 is generally similar to that described above with reference to FIGS. 3A to 3D of the accompanying drawings. It may be introduced at one end of the tube 203 and then pulled back to a position just below the end of tube 203 and into a locked position as illustrated on the right-hand side of the drawing of FIG. 5 (the left-hand side illustrates the end cap in an unlocked position). When in the locked position an annular ring 205 of plastics or other material of generally L-shaped section may be introduced as shown in FIG. 5 in order to prevent any upward movement of the end cap. Ring 205 may be stitched or riveted in position on tube 203. As a result, neither upward nor downward movement of the end cap 201 is possible and the end cap then forms a permanent base or top to the solids container.

I claim:

1. A container having a side wall and a pair of opposed end walls, at least one end wall being in the form of a slidably movable end cap comprising a first portion extending substantially across and enclosing an end of the container, said end cap being within said side wall, and a second portion being integral with and disposed about the perpihery of said first portion; said second portion having co-operative engagement between said first portion and said side wall whereby movement of the end cap axially toward the opposite end wall is allowed, but movement in an opposite direction away from said opposite end wall is opposed by a resisting force resulting from said co-operative engagement, said force increasing automatically with the axial distance moved in said opposite direction; said second portion being an annular or segmented annular portion having a substantially triangular section and being connected at an apical position to said first portion, said second portion having a side opposite said apical portion of a serrated or toothed form for engagement with said side wall, and being located within a space defined between said first portion and said side wall.

2. A container having a side wall and a pair of opposed end walls, at least one end wall being in the form of a slidably movable end cap comprising a first portion extending substantially across the whole of one end of the container, said end cap being within said side wall, and a second portion disposed about the periphery of said first portion, said second portion having co-operative engagement between said first portion and said side wall whereby movement of the end cap axially toward the opposite end wall is allowed, but movement in an opposite direction away from said opposite end wall is opposed by a resisting force resulting from said cooperative engagement, said force increasing automatically with the axial distance moved in said opposite direction; said second portion being shaped so that any initial movement of the end cap away from said opposite end wall causes a rotational movement of the second portion which in turn results in locking engagement between the end cap and the side wall of the container.

3. A container according to claim 2, wherein said second portion is integral with said first portion.

4. A container according to claim 2, wherein said second portion has a substantially triangular section and is connected at an apical position to said first portion, said second portion having a side opposite said apical portion of a serrated or toothed form for engagement with said side wall.

5. A container according to claim 4, including an annular locking ring located adjacent to said cap and rigidly mounted to said side wall at the end of said side wall thereby further resisting any tendency for said cap to move in said opposite direction.

* * * * *